US011209137B2

(12) United States Patent
Shen et al.

(10) Patent No.: US 11,209,137 B2
(45) Date of Patent: Dec. 28, 2021

(54) SPOT DOWNLIGHT APPARATUS

(71) Applicant: XIAMEN ECO LIGHTING CO. LTD., Xiamen (CN)

(72) Inventors: Digen Shen, Xiamen (CN); Changhe Zhong, Xiamen (CN); Jingjing Su, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/860,057

(22) Filed: Apr. 27, 2020

(65) Prior Publication Data

US 2020/0355334 A1 Nov. 12, 2020

(30) Foreign Application Priority Data

May 8, 2019 (CN) ..... 201920650169.X
May 8, 2019 (CN) ..... 201920650201.4
May 8, 2019 (CN) ..... 201920650259.9
May 8, 2019 (CN) ..... 201920655654.6

(51) Int. Cl.

| | |
|---|---|
| ***F21S 8/02*** | (2006.01) |
| ***F21V 29/70*** | (2015.01) |
| ***F21K 9/20*** | (2016.01) |
| ***F21V 19/00*** | (2006.01) |
| ***F21V 21/04*** | (2006.01) |
| ***F21V 21/30*** | (2006.01) |
| *F21Y 115/10* | (2016.01) |

(52) U.S. Cl.

CPC ..... *F21S 8/026* (2013.01); *F21K 9/20* (2016.08); *F21V 19/003* (2013.01); *F21V 21/04* (2013.01); *F21V 21/30* (2013.01); *F21V 29/70* (2015.01); *F21Y 2115/10* (2016.08)

(58) Field of Classification Search

CPC ..... F21K 9/20; F21S 8/066; F21V 23/0421
See application file for complete search history.

(56) References Cited

U.S. PATENT DOCUMENTS

| | | | | |
|---|---|---|---|---|
| 4,959,637 | A * | 9/1990 | Woods | F21V 33/0076 340/321 |
| 10,295,161 | B1 * | 5/2019 | Shih | F21V 14/06 |
| 2005/0174473 | A1 * | 8/2005 | Morgan | H05B 45/37 348/370 |
| 2009/0135602 | A1 * | 5/2009 | Liu | F21V 21/30 362/275 |
| 2011/0181200 | A1 * | 7/2011 | Luk | H05B 45/20 315/294 |
| 2018/0119925 | A1 * | 5/2018 | Yamae | G02B 27/0938 |

(Continued)

*Primary Examiner* — Leah Simone Macchiarolo
(74) *Attorney, Agent, or Firm* — Chun-Ming Shih; Lanway IPR Services

(57) ABSTRACT

The spot downlight apparatus includes a power head, a tubular body, a back cover, a light source plate, a heat sink, in insulation layer and a lens module. The power head is connected to an external power source. The power head has a rotation structure. The tubular body is made of metal material. The tubular body has a front opening and a back opening. The tubular body is fixed to the rotation structure so as to be manually rotated with respect to the power head. The back cover is fixed to the back opening of the tubular body. The light source plate is mounted with a LED module. The heat sink has a platform holder and a sidewall. The lens module has a top part and a bottom wall.

18 Claims, 11 Drawing Sheets

(56) References Cited

U.S. PATENT DOCUMENTS

| | | | | |
|---|---|---|---|---|
| 2018/0139823 | A1* | 5/2018 | Hick | H05B 47/11 |
| 2018/0142871 | A1* | 5/2018 | Morales | F21V 21/14 |
| 2021/0003272 | A1* | 1/2021 | Zhang | F21V 23/009 |

* cited by examiner

SPOT DOWNLIGHT APPARATUS

FIELD

The present application is related to a lighting apparatus and more particularly related to a spot downlight apparatus.

BACKGROUND

Electroluminescence, an optical and electrical phenomenon, was discovered in 1907. Electroluminescence refers the process when a material emits light when a passage of an electric field or current occurs. LED stands for light-emitting diode. The very first LED was reported being created in 1927 by a Russian inventor. During decades' development, the first practical LED was found in 1961, and was issued patent by the U.S. patent office in 1962. In the second half of 1962, the first commercial LED product emitting low-intensity infrared light was introduced. The first visible-spectrum LED, which limited to red, was then developed in 1962.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

With high light output, LEDs are available across the visible, infrared wavelengths, and ultraviolet lighting fixtures. Recently, there is a high-output white light LED. And this kind of high-output white light LEDs are suitable for room and outdoor area lighting. Having led to new displays and sensors, LEDs are now be used in advertising, traffic signals, medical devices, camera flashes, lighted wallpaper, aviation lighting, horticultural grow lights, and automotive headlamps. Also, they are used in cellphones to show messages.

A Fluorescent lamp refers to a gas-discharge lamps. The invention of fluorescent lamps, which are also called fluorescent tubes, can be traced back to hundreds of years ago. Being invented by Thomas Edison in 1896, fluorescent lamps used calcium tungstate as the substance to fluoresce then. In 1939, they were firstly introduced to the market as commercial products with variety of types.

In a fluorescent lamp tube, there is a mix of mercury vapor, xenon, argon, and neon, or krypton. A fluorescent coating coats on the inner wall of the lamp. The fluorescent coating is made of blends of rare-earth phosphor and metallic salts. Normally, the electrodes of the lamp comprise coiled tungsten. The electrodes are also coated with strontium, calcium oxides and barium. An internal opaque reflector can be found in some fluorescent lamps. Normally, the shape of the light tubes is straight. Sometimes, the light tubes are made circle for special usages. Also, u-shaped tubes are seen to provide light for more compact areas.

Because there is mercury in fluorescent lamps, it is likely that the mercury contaminates the environment after the lamps are broken. Electromagnetic ballasts in fluorescent lamps are capable of producing buzzing mouse. Radio frequency interference is likely to be made by old fluorescent lamps. The operation of fluorescent lamps requires specific temperature, which is best around room temperature. If the lamps are placed in places with too low or high temperature, the efficacy of the lamps decreases.

In real lighting device design, details are critical no matter how small they appear. For example, to fix two components together conveniently usually brings large technical effect in the field of light device particularly when any such design involves a very large number of products to be sold around the world.

It is also important to consider how to conveniently install a lighting apparatus. Particularly, many societies face aging problems. More and more old people need to replace or install lighting devices by themselves. Labor cost for installing lighting devices is also increasing. It is therefore beneficial to design a better way to install various lighting devices.

In some applications, it is important to project a light on an object or an area to emphasize the object or the area.

A spot light may be used. The spot light needs to be easily installed, with great heat dissipation capability and low cost. Therefore, it is beneficial and challenging to design a better spot light downlight device.

SUMMARY

In some embodiments, a spot downlight apparatus includes a power head, a tubular body, a back cover, a light source plate, a heat sink, in insulation layer and a lens module.

The power head is connected to an external power source. The power head has a rotation structure. The tubular body is made of metal material. The tubular body has a front opening and a back opening. The tubular body is fixed to the rotation structure so as to be manually rotated with respect to the power head.

In some other embodiments, the tubular body is made of non-metal material, or mixed material with metal and non-metal. For example, the tubular body may be made of heat conductive plastic material.

The back cover is fixed to the back opening of the tubular body. The light source plate is mounted with a LED module. In some embodiments, the LED module includes multiple LED chips which are welded to the light source plate. In some other embodiments, the LED module is COB (Chip on Board) package component. The COB LED module is placed below the light source plate and there is a COB bracket disposed above the light source plate together for fixing the COB LED module.

The heat sink has a platform holder and a sidewall. The sidewall engages an inner surface of the tubular body. For example, the heat sink has circular disk as the platform holder for engaging and supporting the light source plate, a surrounding wall connected to peripheral edge of the circular disk is used as the side wall. The heat transmitted on the circular disk is further and easily transmitted to the sidewall. The sidewall contacts the inner surface of the tubular body. When the tubular body is made of metal material or other heat conductive material, the heat is transmitted to the tubular body for getting better heat dissipation effect.

The insulation layer is made of a heat conductive material for transmitting heat of the light source plate to the heat sink and then to the tubular body. In other words, the insulation layer is disposed for preventing the light source plate directly in contact with the tubular body particularly when both components are made of metal material, which may cause certain safety concern. For example, the light source plate may be wrapped with insulation material enclosing a metal substrate, there is still danger for causing certain electric shock on the surface of the tubular body, when the tubular body is made of metal material, which may connect electricity.

The lens module has a top part and a bottom wall, the bottom wall enclosing the LED module.

In some embodiments, the LED module is a COB LED module, the LED module is placed below the light source plate, and a COB bracket is disposed above the light source plate.

In some embodiments, a driver component is disposed on the light source plate.

In some embodiments, the LED module is located inside the bottom wall and the driver component is located outside the bottom wall.

In some embodiments, the LED module is a high voltage (HV) LED device operating under high voltage. High voltage LED chips series (HV chips) are the LED light source with high light efficacy and great cost and performance ratio. Light efficacy of cold white light reaches 162 lm/W, and warm white light reaches 170 lm/W. HV chips are able to be driven under high voltage power directly. Total cost and reliability are superior to other LED chips. According to the test result from our clients, power consumption of other 800 lm LED bulbs in the market is around 12 W, which means light efficacy is less than 70 lm/W. By using HV chips, LED bulbs produced by NANYA Photonics and Delta Electronics are able to reach 820 lm and 886 lm with power consumption 8.5 W and 8.3 W, equals to light efficacy reaches 100 lm/W. It shows that HV chips are able to save 30% power consumption under the same condition if it is compared to other LED bulbs. HV chips completely demonstrate the advantages of LED and help to make a distribution on environmental protection and energy saving.

The superior light efficacy and cost performance ratio of HV chips come from following unique technologies. First, the epitaxy construction (nano-porous p-GaN) improves light extraction efficiency and lowers forward voltage. Second, TSB technology (transparent substrate bonding) improves light extraction efficiency. Third, by adopting micro cell electricity connecting technology to produce HV chip, the consumption of driver becomes less and there's no need to lose power by lowering voltage sharply. Fourth, new epitaxy construction lowers coefficient of temperature of chips and improves light efficacy and stability of color temperature in hot steady state. By developing and actualizing four technologies above, the gap of light efficacy between cold white light and warm white light is the smallest of the world. And the well-spreading tiny holes in appropriate size in epitaxy structure are just the key to make the light extraction efficiency reach 90%.

In some embodiments, the back cover is mounted with a driver component.

In some embodiments, the driver component is stored in a driver container fixed to the back cover.

In some embodiments, the driver component is a capacitor for decreasing flicking of the LED module.

In some embodiments, the heat sink is fixed to the light source plate with at least one metal screw.

Clearance is the shortest distance in air between two conductive parts. Clearance shall be dimensioned to withstand the required impulse withstand voltage, in accordance to table "Clearances to withstand transient overvoltages". Larger clearances may be required due to mechanical influences such as vibration or applied forces.

Inasmuch as the values indicated in the aforementioned tables are applicable up to 2,000 meters above sea level, clearance for greater heights must be calculated using the multiplication factors in the "Altitude correction factors" table.

Creepage distance means the shortest distance along the surface of a solid insulating material between two conductive parts. The values of table "Creepage distances to avoid failure due to tracking" are based upon existing data and are suitable for the majority of applications.

The basis for the determination of a creepage distance is the long-term r.m.s. value of the voltage existing across it. This voltage is the working voltage, the rated insulation voltage or the rated voltage.

The influence of the degrees of pollution in the micro-environment on the dimensioning of creepage distances is taken into account in table "Creepage distances to avoid failure due to tracking". To keep in mind is also that in the same equipment, different micro-environment conditions can exist.

A creepage distance cannot be less than the associated clearance so that the shortest creepage distance possible is equal to the required clearance. However, there is no physical relationship, other than this dimensional limitation, between the minimum clearance in air and the minimum acceptable creepage distance.

By adding the fixing blocks, the creepage distance is increased to make the lighting apparatus safer. The fixing blocks are made of insulation material for increasing creepage distance.

In some embodiments, there is a fixing block surrounding the metal screw, the fixing block is made of electricity insulation material.

In some embodiments, the light source plate has two opposite concave areas for fixing two metal screws.

In some embodiments, a top surface of the top part of the lens module includes multiple tiny lens in a center area of the top surface.

In some embodiments, a peripheral area surrounding the center area of the top surface is kept plane.

In some embodiments, the lens module is a convex lens facing to the LED module, the convex lens is surrounded by the bottom wall.

In some embodiments, the tubular body includes a track, a relative distance between the LED module and the lens module is adjusted by moving the power head with respect to the tubular body along the track.

In some embodiments, a back portion of the tubular body is between a connection position of the heat sink to the power head, the back portion has an air exit for heat dissipation.

In some embodiments, a fan is disposed inside the back portion of the tubular body.

In some embodiments, the insulation layer has a central opening.

In some embodiments, the back cover is rotated to set a working mode of the LED module.

In some embodiments, the tubular body mode is detachable plugged to the power head via a connector, the connector provides a structural support and an electrical connection.

DETAILED DESCRIPTION

Figure 1:
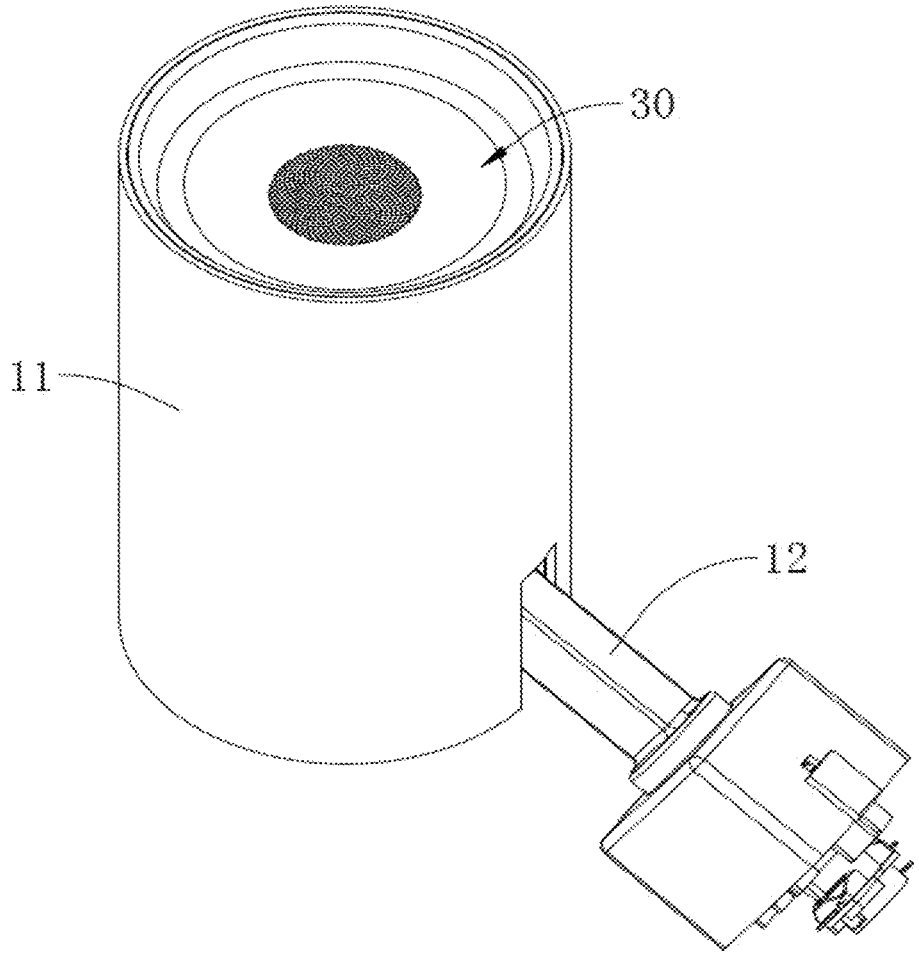
FIG. 1 illustrates a spot downlight embodiment.

In FIG. 1, a spot downlight apparatus includes a power head 12, a tubular body 11, a back cover, a light source plate, a heat sink, in insulation layer and a lens module 30.

In FIG. 1, the tubular body 11 is rotatable with respect to the power head 12 for adjusting a light output direction of the spot downlight apparatus.

Figure 2:
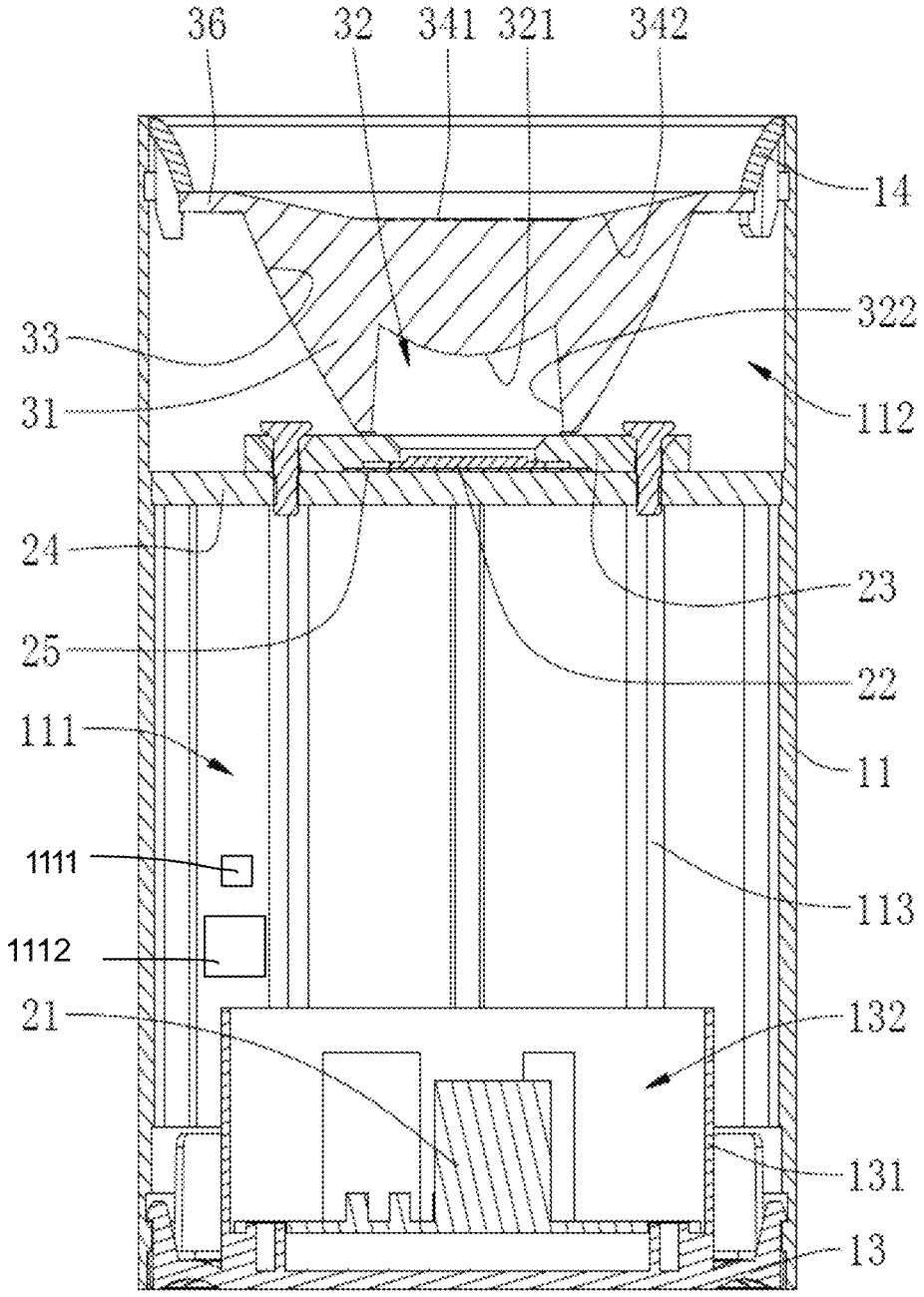
FIG. 2 illustrates a cross section view of the embodiment in FIG. 1.

FIG. 2 shows a cross section view showing components in an embodiment.

In FIG. 2, a surface ring 14 is used for fixing a lens module 33. The lens module has a top end 36 to be pressed by the surface ring 14 to fix to the spot downlight apparatus. The lens module 33 has a bottom wall 31. The bottom wall 31 has inner surface 322 with vertical side perpendicular to the COB bracket 23. There is a convex lens 321 surrounding by the bottom wall 31 of the lens module 33 facing to a COB LED module 22. There is an insulation layer 25 between the COB LED module 22, the COB bracket 23 and a heat sink 24. In this case, the heat sink 24 is a metal plate contact with an inner surface of the tubular body 11 for carrying heat from the COB LED module 22 to the tubular body 11. The lens module 33 has a top part. The top part has a center area 341 disposed with multiple tiny lens. The top part also has a peripheral area 342 kept plane, i.e. as a plane surface with a tilt angle or without a tilt angle. The lens module 33 defines an inner light space 32 surrounding the COB LED module 22. The light of the COB LED module 22 is guided by reflection, infraction from the COB LED module 22 to the center area 341 and the peripheral area 342 to escape outside the spot downlight apparatus as a light beam projected on an emphasized object or an emphasized area. The tubular body 11 has a connection position for the heat sink 24. The connection position of the heat sink 24 logically divides the tubular body 11 as a back portion 111 and a front portion 112. The back portion 111 has an air exit 1111 for air flowing to perform better heat dissipation. In some embodiments, there is a fan 1112 which may be connected to a power source for supplying power to the COB LED module for helping moving air into or exiting the tubular body 11. There is wire 113 for transmitting electricity from an indoor power source to the COB LED module 22. There is a back cover 131. The back cover 13 has a cover wall 131 defining a driver container 132 for placing a driver component 21 like a capacitor for decreasing flicking of the COB LED module.

Figure 3:
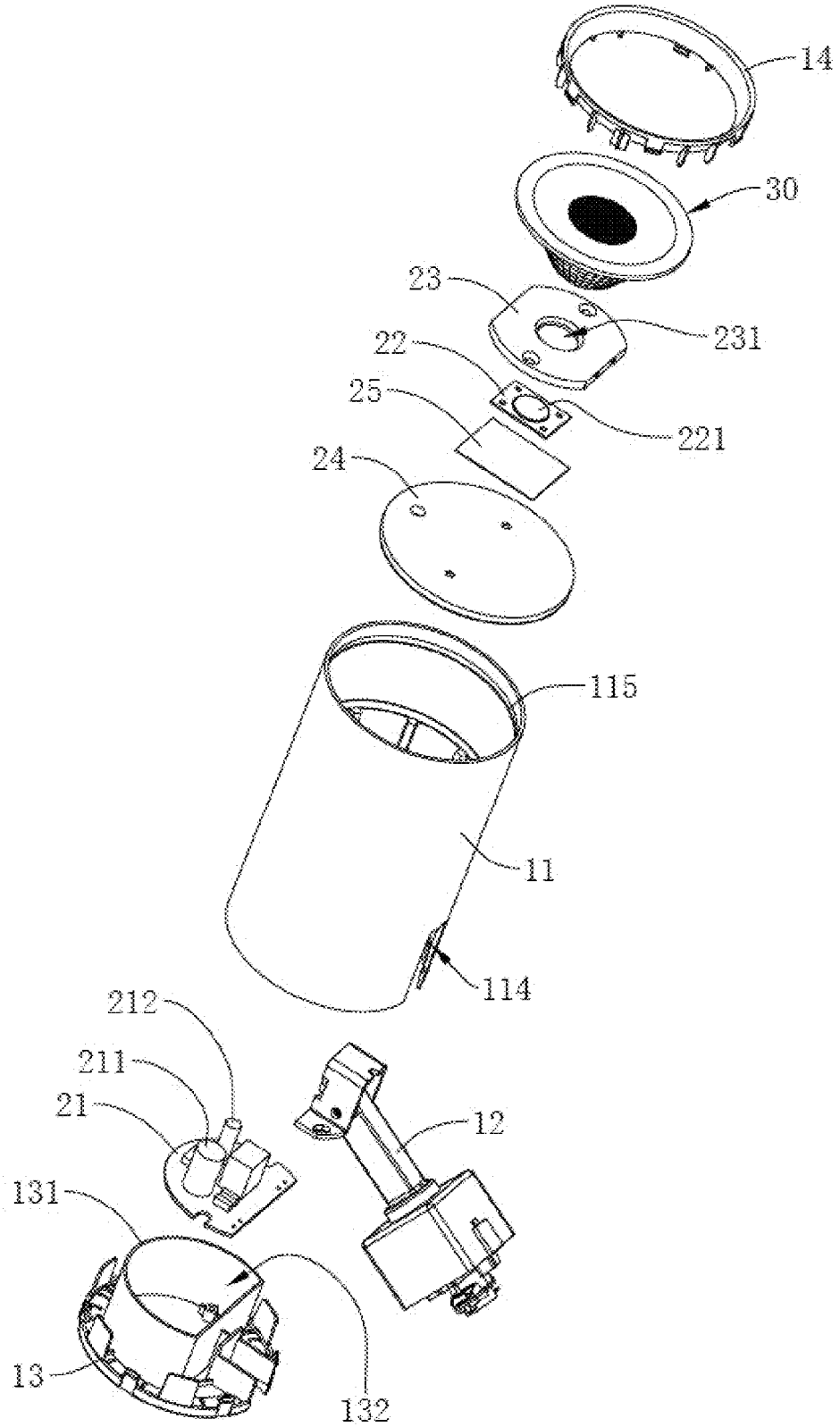
FIG. 3 illustrates an exploded view of the example in FIG. 1.

Please refer to FIG. 3, which shows an exploded view of a spot downlight apparatus in FIG. 2. There are a surface ring 14, a lens module 30, and a COB bracket 23 which may be regarded as a light source plate having an opening for exposing the COB LED module 22 that has a COB LED chip 221. There is an insulation layer 25 between the heat sink 24 and the light source plate of COB bracket 23, the COB LED module 22.

The tubular body 11 has a groove 115 for installing and positioning the lens module 30. The tubular body 11 has a rotation opening 114 providing a rotation space for rotating the tubular body 11 and the power head 12. The power head 12 is connected to an indoor power source like a 110V/220V alternating current source. There is a back cover 13 with a driver container 131 defining a container space for placing a driver 21 with a capacitor 211 and other driver components 212.

Figure 4:
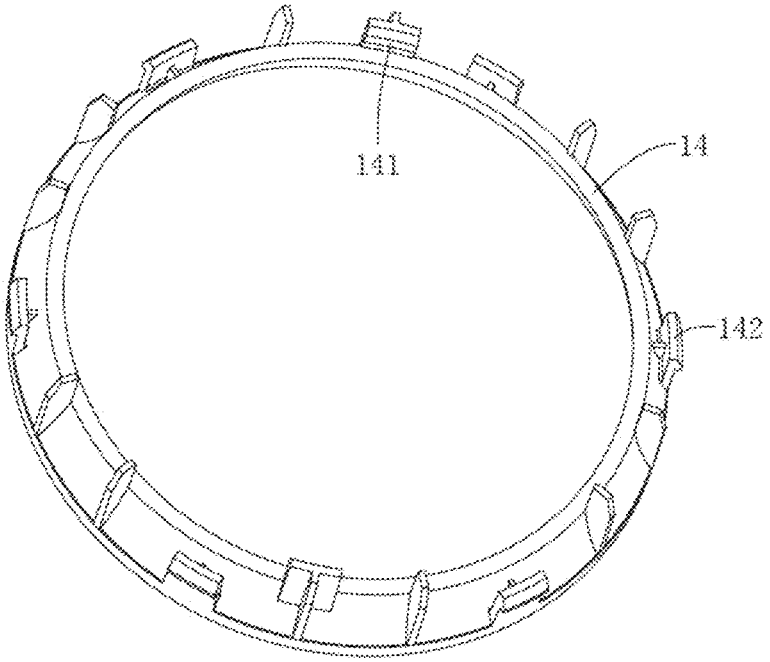
FIG. 4 illustrates a front cover ring example.

FIG. 4 shows a surface ring 14 with some clipping structures 141, 142 for fixing to the tubular body and for fixing the lens module.

Figure 5:
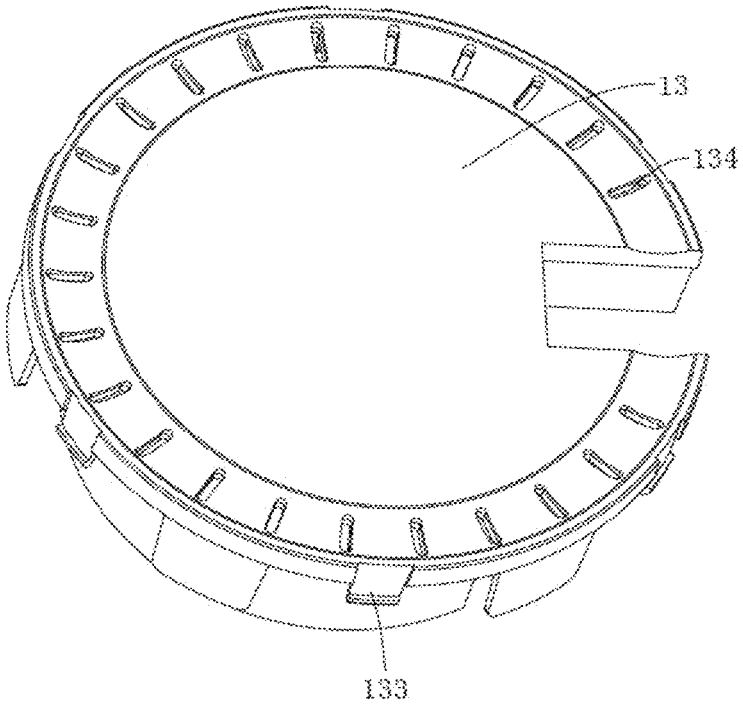
FIG. 5 illustrates a back cover example.

FIG. 5 shows a back cover 13. There is an air exit 134 or heat dissipation and a clip structure 133 for fixing to the tubular body.

Figure 6:
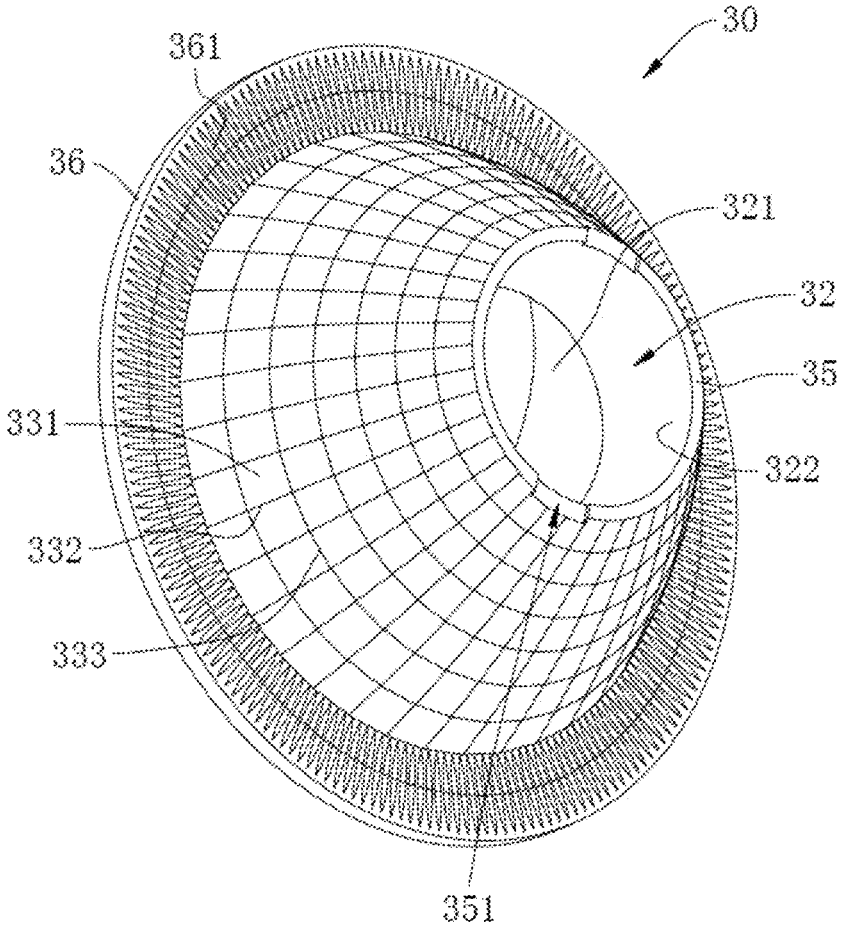
FIG. 6 illustrates a lens example.

FIG. 6 shows a lens module 30. The lens module has a convex lens 321 facing to the LED module. There is a lens space for lights to reflect or infract to desired directions. The bottom edge 35 may engage the light source plate. The bottom wall 322 surrounds the LED module. The positioning groove 351 is used for aligning to the connection position to the light source plate. The reflective portion 331 has cross groove lines 332, 333. Along the ring edge 36, there are also convex-concave lines 361 for enhancing light condensing effect.

Figure 7:
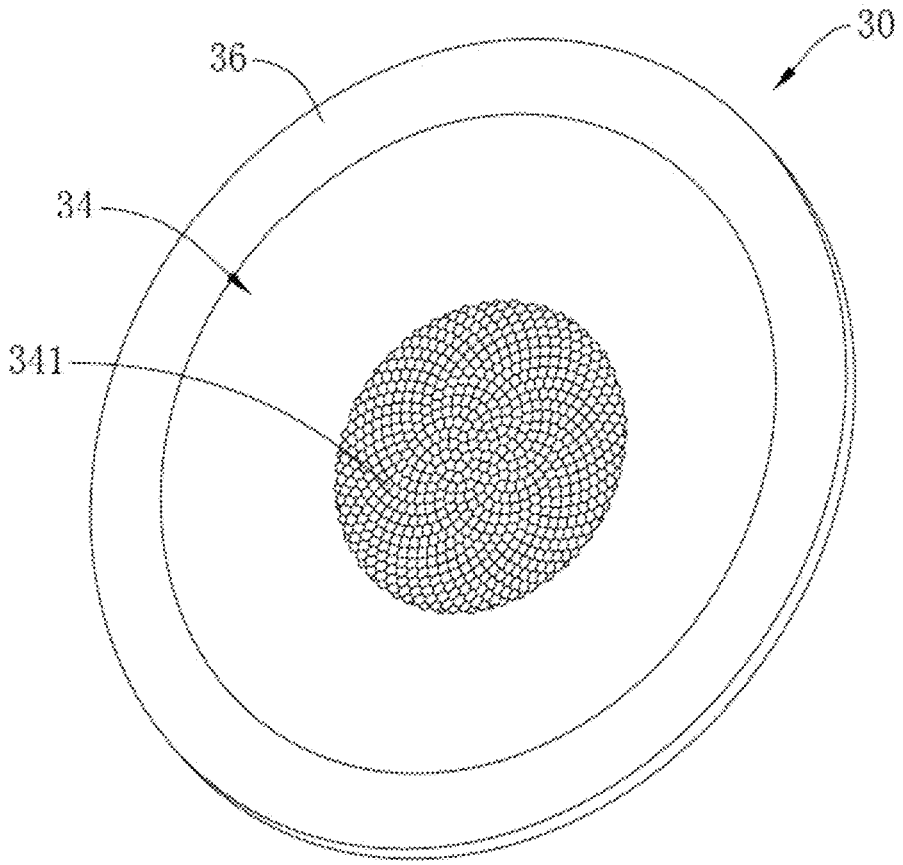
FIG. 7 illustrates another view of the example in FIG. 6.

FIG. 7 shows another side of a lens module 30, which has top art 34. There is a ring edge 36. Inside the ring edge 36, there is a center area 341 filled with tiny lens for further enhancing light beam effect.

Figure 8:
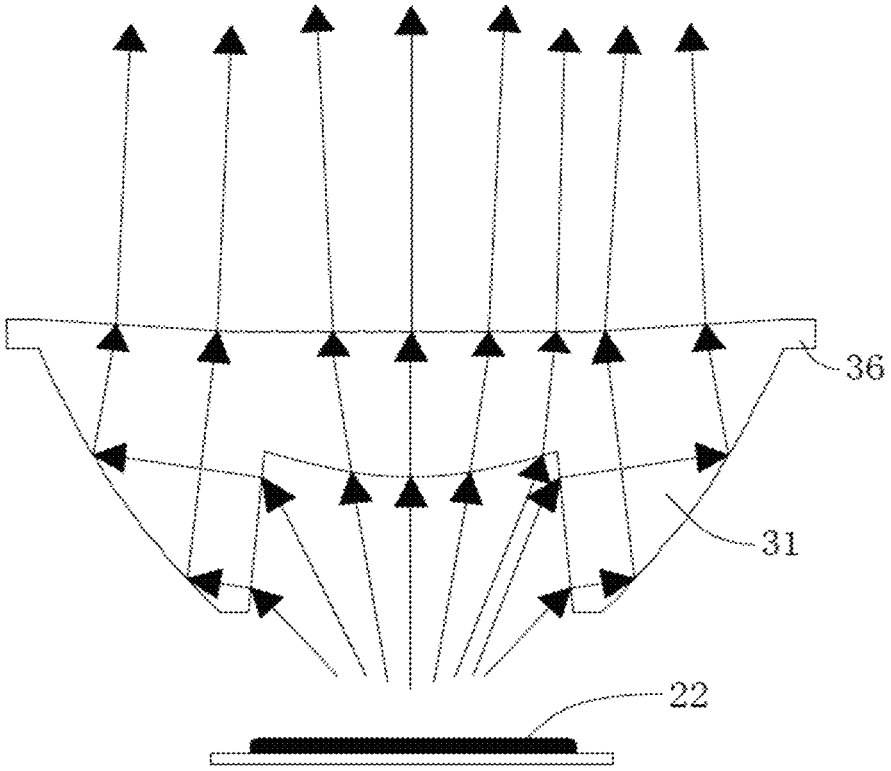
FIG. 8 illustrates light paths in a lens module.

FIG. 8 shows light paths in a lens module. The lens adjuster 31 changes light paths for guiding light from the COB LED module 22 to emit lights to desire directions surrounded by the ring edge 36.

Figure 9:
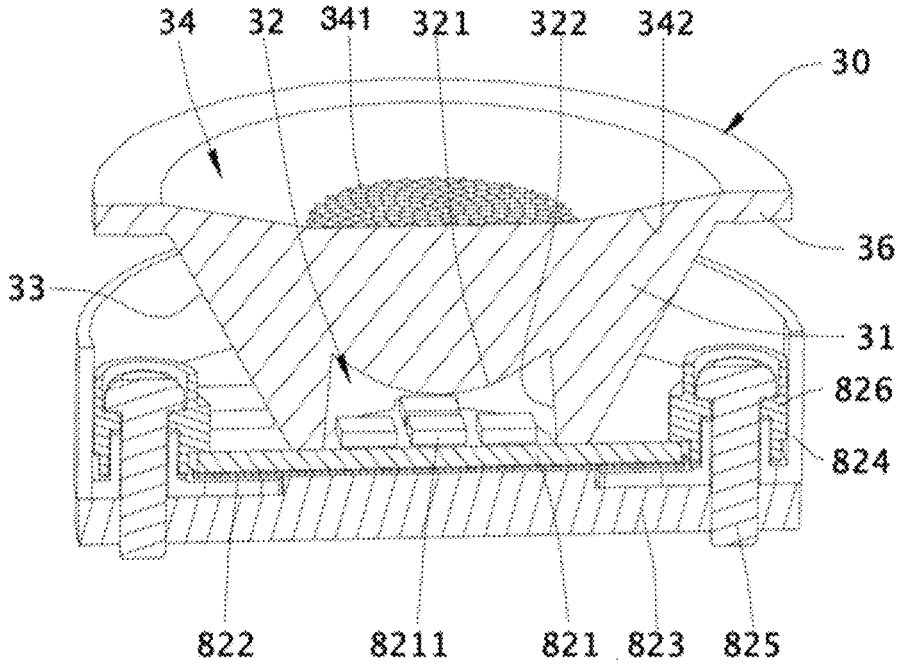
FIG. 9 illustrates another embodiment.

FIG. 9 shows another embodiment. Reference numerals the same as other drawings represent the same components, like the lens module 30 in FIG. 9. The lens module 30 is placed above a LED module 8211. The LED module 8211 is placed on a light source plate 821. The light source plate 821 is heat connected to the heat sink 823 via an insulation layer 822 that is heat conductive but not electricity conductive. There are metal screws 825 fixing the components together for increasing heat dissipation at the same time. In addition, to increase creepage distance, there are fixing blocks 826 enclosing the screws and adding creeping distance of the light source plate 821 to a metal surface 824 of the tubular body.

Figure 10:
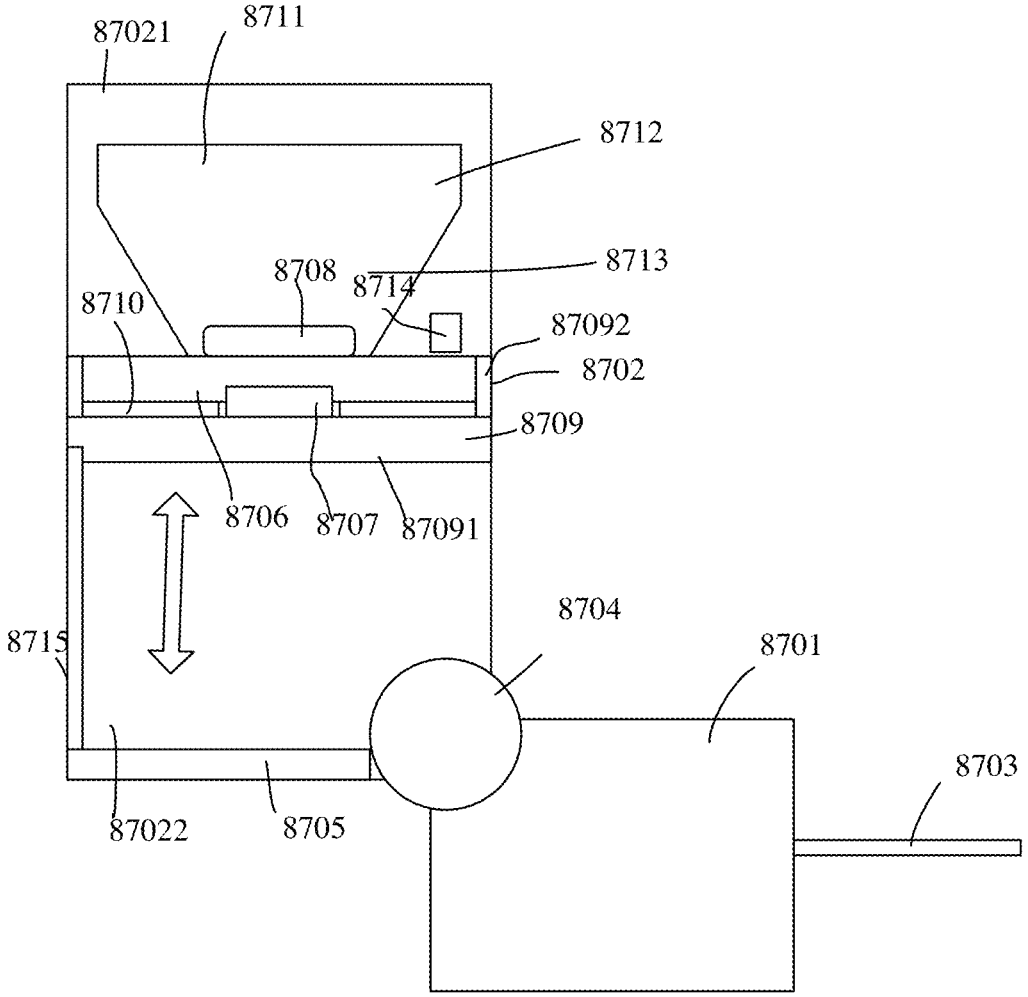
FIG. 10 illustrates a structural view of an embodiment.

In FIG. 10, a spot downlight apparatus a power head 8701 connected to an external power source 8703. The power head 8702 has a rotation structure 8704. A tubular body 8702 is made of metal material. The tubular body 8702 has a front opening 87021 and a back opening 87022. The tubular body 8702 is fixed to the rotation structure 8704 so as to be manually rotated with respect to the power head 88701.

A back cover 8705 is fixed to the back opening 87022 of the tubular body 8702.

A light source plate 8706 mounted with a LED module 8707. In this example, the LED module 8707 is a COB LED module and there is also a COB (Chip on Board) bracket 8708 on a different side of the light source plate 8706.

A heat sink 8709 with a platform holder 87091 and a sidewall 87092. The sidewall 87092 engages an inner surface of the tubular body 8702.

There is an insulation layer 8710 made of a heat conductive material for transmitting heat of the light source plate 8706 to the heat sink 8709 and then to the tubular body 8702.

A lens module 8711 with top part 8711 and a bottom wall 8712. The bottom wall 8712 encloses the LED module 8707 by surrounding the LED module 8707.

A driver component 8714 is placed outside the bottom wall 8713 of the lens module 8711. There is track for changing a distance between the LED module 8707 and the lens module 8711.

In some other embodiments, the tubular body is made of non-metal material, or mixed material with metal and non-metal. For example, the tubular body may be made of heat conductive plastic material.

The back cover is fixed to the back opening of the tubular body. The light source plate is mounted with a LED module. In some embodiments, the LED module includes multiple LED chips which are welded to the light source plate. In some other embodiments, the LED module is COB (Chip on Board) package component. The COB LED module is placed below the light source plate and there is a COB bracket disposed above the light source plate together for fixing the COB LED module.

The heat sink has a platform holder and a sidewall. The sidewall engages an inner surface of the tubular body. For example, the heat sink has circular disk as the platform holder for engaging and supporting the light source plate, a surrounding wall connected to peripheral edge of the circular disk is used as the side wall. The heat transmitted on the circular disk is further and easily transmitted to the sidewall. The sidewall contacts the inner surface of the tubular body. When the tubular body is made of metal material or other heat conductive material, the heat is transmitted to the tubular body for getting better heat dissipation effect.

The insulation layer is made of a heat conductive material for transmitting heat of the light source plate to the heat sink and then to the tubular body. In other words, the insulation layer is disposed for preventing the light source plate directly in contact with the tubular body particularly when both components are made of metal material, which may cause certain safety concern. For example, the light source plate may be wrapped with insulation material enclosing a metal substrate, there is still danger for causing certain electric shock on the surface of the tubular body, when the tubular body is made of metal material, which may connect electricity.

The lens module has a top part and a bottom wall. The bottom wall surrounds and encloses the LED module.

In some embodiments, the LED module is a COB LED module, the COB LED module is placed below the light source plate, and a COB bracket is disposed above the light source plate.

In some embodiments, a driver component is disposed on the light source plate.

In some embodiments, the LED module is located inside the bottom wall and the driver component is located outside the bottom wall.

In some embodiments, the LED module is a high voltage (HV) LED device operating under high voltage. High voltage LED chips series (HV chips) are the LED light source with high light efficacy and great cost and performance ratio. Light efficacy of cold white light reaches 162 lm/W, and warm white light reaches 170 lm/W. HV chips are able to be driven under high voltage power directly. Total cost and reliability are superior to other LED chips. According to the test result from our clients, power consumption of other 800 lm LED bulbs in the market is around 12 W, which means light efficacy is less than 70 lm/W. By using HV chips, LED bulbs produced by NANYA Photonics and Delta Electronics are able to reach 820 lm and 886 lm with power consumption 8.5 W and 8.3 W, equals to light efficacy reaches 100 lm/W. It shows that HV chips are able to save 30% power consumption under the same condition if it is compared to other LED bulbs. HV chips completely demonstrate the advantages of LED and help to make a distribution on environmental protection and energy saving.

The superior light efficacy and cost performance ratio of HV chips come from following unique technologies. First, the epitaxy construction (nano-porous p-GaN) improves light extraction efficiency and lowers forward voltage. Second, TSB technology (transparent substrate bonding) improves light extraction efficiency. Third, by adopting micro cell electricity connecting technology to produce HV chip, the consumption of driver becomes less and there's no need to lose power by lowering voltage sharply. Fourth, new epitaxy construction lowers coefficient of temperature of chips and improves light efficacy and stability of color temperature in hot steady state. By developing and actualizing four technologies above, the gap of light efficacy between cold white light and warm white light is the smallest of the world. And the well-spreading tiny holes in appropriate size in epitaxy structure are just the key to make the light extraction efficiency reach 90%.

In some embodiments, the back cover is mounted with a driver component.

In some embodiments, the driver component is stored in a driver container fixed to the back cover.

In some embodiments, the driver component is a capacitor for decreasing flicking of the LED module.

In some embodiments, the heat sink is fixed to the light source plate with at least one metal screw.

Clearance is the shortest distance in air between two conductive parts. Clearance shall be dimensioned to withstand the required impulse withstand voltage, in accordance to table "Clearances to withstand transient over voltages". Larger clearances may be required due to mechanical influences such as vibration or applied forces.

Inasmuch as the values indicated in the aforementioned tables are applicable up to 2,000 meters above sea level, clearance for greater heights must be calculated using the multiplication factors in the "Altitude correction factors" table.

Creepage distance means the shortest distance along the surface of a solid insulating material between two conductive parts. The values of table "Creepage distances to avoid failure due to tracking" are based upon existing data and are suitable for the majority of applications.

The basis for the determination of a creepage distance is the long-term r.m.s. value of the voltage existing across it. This voltage is the working voltage, the rated insulation voltage or the rated voltage.

The influence of the degrees of pollution in the micro-environment on the dimensioning of creepage distances is taken into account in table "Creepage distances to avoid failure due to tracking". To keep in mind is also that in the same equipment, different micro-environment conditions can exist.

A creepage distance cannot be less than the associated clearance so that the shortest creepage distance possible is equal to the required clearance. However, there is no physical relationship, other than this dimensional limitation, between the minimum clearance in air and the minimum acceptable creepage distance.

By adding the fixing blocks, the creepage distance is increased to make the lighting apparatus safer. The fixing blocks are made of insulation material for increasing creepage distance.

In some embodiments, there is a fixing block surrounding the metal screw, the fixing block is made of electricity insulation material.

In some embodiments, the light source plate has two opposite concave areas for fixing two metal screws.

In some embodiments, a top surface of the top part of the lens module includes multiple tiny lens in a center area of the top surface.

In some embodiments, a peripheral area surrounding the center area of the top surface is kept plane.

In some embodiments, the lens module is a convex lens facing to the LED module, the convex lens is surrounded by the bottom wall.

In some embodiments, the tubular body includes a track, a relative distance between the LED module and the lens module is adjusted by moving the power head with respect to the tubular body along the track.

In some embodiments, a back portion of the tubular body is between a connection position of the heat sink to the power head, the back portion has an air exit for heat dissipation.

In some embodiments, a fan is disposed inside the back portion of the tubular body.

In some embodiments, the insulation layer has a central opening.

In some embodiments, the back cover is rotated to set a working mode of the LED module. For example, the back cover rotates an angle and the angle changes is transmitted to a driver component.

Figure 11:
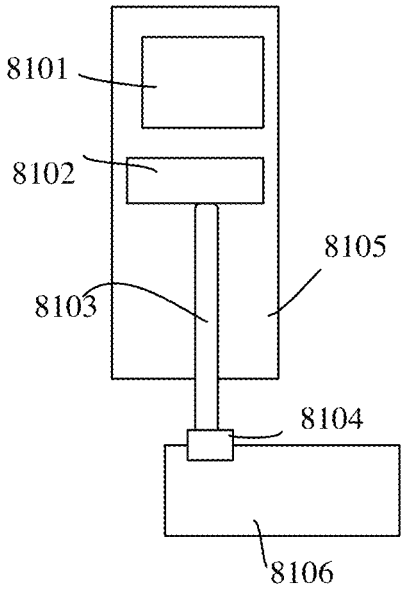
FIG. 11 shows another embodiment.

In FIG. 11, the tubular body 8105 is detachable plugged to the power head 8106 via a connector 8104. The connector 8104 provides a structural support and an electrical connection. By pulling the tubular body 8105 forward or backward, the light source plate 8102 is moved with a different relative distance to the lens module 8101 for changing a light beam angle along a track 8103.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A spot downlight apparatus comprising:

a power head connected to an external power source, the power head has a rotation structure;

a tubular body made of metal material, the tubular body having a front opening and a back opening, the tubular body is fixed to the rotation structure so as to be manually rotated with respect to the power head;

a back cover fixing to the back opening of the tubular body;

a light source plate mounted with a LED module;

a heat sink with a platform holder and a sidewall, wherein the sidewall engages an inner surface of the tubular body;

an insulation layer made of a heat conductive material for transmitting heat of the light source plate to the heat sink and then to the tubular body; and a lens module with top part and a bottom wall, the bottom wall enclosing the LED module, wherein a driver component is disposed on the light source plate, wherein the driver component is placed on the same side as the lens, wherein the LED module is located inside the bottom wall and the driver component is located outside the bottom wall.

2. The spot downlight apparatus of claim 1, wherein the LED module is a COB LED module, the LED module is placed below the light source plate, and a COB bracket is disposed above the light source plate.

3. The spot downlight apparatus of claim 1, wherein the LED module is a high voltage LED device operating under high voltage.

4. The spot downlight apparatus of claim 1, wherein the back cover is mounted with a driver component.

5. The spot downlight apparatus of claim 4, wherein the driver component is stored in a driver container fixed to the back cover.

6. The spot downlight apparatus of claim 4, wherein the driver component is a capacitor for decreasing flicking of the LED module.

7. The spot downlight apparatus of claim 1, wherein the heat sink is fixed to the light source plate with at least one metal screw.

8. The spot downlight apparatus of claim 7, wherein there is a fixing block surrounding the metal screw, the fixing block is made of electricity insulation material.

9. The spot downlight apparatus of claim 7, wherein the light source plate has two opposite concave areas for fixing two metal screws.

10. The spot downlight apparatus of claim 1, wherein a top surface of the top part of the lens module comprises multiple tiny lens in a center area of the top surface.

11. The spot downlight apparatus of claim 10, wherein a peripheral area surrounding the center area of the top surface is kept plane.

12. The spot downlight apparatus of claim 1, wherein the lens module is a convex lens facing to the LED module, the convex lens is surrounded by the bottom wall.

13. The spot downlight apparatus of claim 1, wherein the tubular body comprises a track, a relative distance between the LED module and the lens module is adjusted by moving the power head with respect to the tubular body along the track.

14. The spot downlight apparatus of claim 1, wherein a back portion of the tubular body is between a connection position of the heat sink to the power head, the back portion has an air exit for heat dissipation.

15. The spot downlight apparatus of claim 14, wherein a fan is disposed inside the back portion of the tubular body.

16. The spot downlight apparatus of claim 1, wherein the insulation layer has a central opening.

17. The spot downlight apparatus of claim 1, wherein the back cover is rotated to set a working mode of the LED module.

18. The spot downlight apparatus of claim 1, wherein the tubular body mode is detachable plugged to the power head via a connector, the connector provides a structural support and an electrical connection.

* * * * *